US005459450A

United States Patent [19]

Beghelli

[11] Patent Number: 5,459,450

[45] Date of Patent: Oct. 17, 1995

[54] PRESENCE-DETECTING SYSTEM

[75] Inventor: Gian P. Beghelli, Monteveglio, Italy

[73] Assignee: Beghelli S.R.L., Monteveglio, Italy

[21] Appl. No.: 333,246

[22] Filed: Nov. 1, 1994

Related U.S. Application Data

[63] Continuation of Ser. No. 16,867, Feb. 11, 1993, abandoned.

[30] Foreign Application Priority Data

Feb. 20, 1992 [IT] Italy ..... BO92A0058

[51] Int. Cl.[6] ..... G08B 1/08

[52] U.S. Cl. ..... 340/538; 340/310.01; 340/310.08; 340/565; 340/573

[58] Field of Search ..... 340/538, 310 CP, 340/310 R, 288, 565, 541, 555–557, 573, 506, 531, 632, 825.22, 825.77, 310.01, 310.08

[56] References Cited

U.S. PATENT DOCUMENTS

| | | | |
|---|---|---|---|
| 3,633,199 | 1/1972 | Curry | 340/310 R |
| 3,805,265 | 4/1974 | Lester | 340/310 CP |
| 4,660,023 | 4/1987 | Thern et al. | 340/538 |
| 4,807,255 | 2/1989 | Idland | 340/538 |
| 4,812,821 | 3/1987 | Santy et al. | 340/310 CP |
| 5,157,383 | 10/1992 | Fisher | 340/538 |

*Primary Examiner*—Brent Swarthout
*Assistant Examiner*—Nina Tong
*Attorney, Agent, or Firm*—Herbert Dubno; Andrew Wilford

[57] ABSTRACT

A system for detecting presences has modules or devices equipped with electronic circuits for the transmission and reception of binary messages by carrier current passing through the normal domestic electric network. The devices, connected to the electric network by an incorporated plug, are in addition equipped with actuators for the control (command) of the electric power equipment in order to intercommunicate at an equivalent rank level. This system consisting of an ensemble of several devices of the above-mentioned kind associated with devices having presence-detecting characteristics is capable of carrying out the function of an anti-intrusion alarm installation.

2 Claims, 2 Drawing Sheets

PRESENCE-DETECTING SYSTEM

This is a continuation of application Ser. No. 08/016,867 filed on Feb. 11, 1993 is now abandoned.

FIELD OF THE INVENTION

My present invention relates to a presence-detecting system. More particularly this invention concerns such a system comprising numerous electronic transmitter/receiver devices intercommunicating by carrier-current techniques using the electrical power network or mains.

BACKGROUND OF THE INVENTION

The possibility of using the normal electric power network existing in buildings as a channel for the transmission of electric signals is known. A high-frequency sinusoidal carrier wave which is modulated by the signal to be transmitted is used with systems of the FSK (Frequency Shift Keying) modulation type, i.e. "with frequency shift." This system can be generally identified as the "technique of conveyor waves" or as carrier current transmission.

It is also known for instance in data management of local area networks (LAN), although pertaining particularly to the method of access of the transmission means, to use either techniques of the deterministic type (whereby the access can take place only at predetermined instances), or techniques of the nondeterministic type (based on algorithms which allow the access on a probabilistic basis). To the first category belong methods referred to as "token passing", with register insertion and "time slot" with time intervals. To the second category belong the methods known as "CSMA" (multiple access with carrier detection) and "CSMA/CD" (multiple access with carrier detection/collision detection).

It is also known to use sensors of various types for the detection of one or several presences (intrusions).

OBJECTS OF THE INVENTION

It is the principal object of my present invention to provide an improved presence-detection system, particularly as an intrusion alarm, which can allow numerous alarm conditions to be transmitted to a central station, which will allow frequent central station monitoring of the readiness of the or each sensing station and which nevertheless is relatively simple and inexpensive construction.

Another object of the invention is to provide an improved presence-detecting system which is free from drawbacks and disadvantages of the prior-art systems which have been described.

SUMMARY OF THE INVENTION

These objects and others which will become more readily apparent hereinafter are attained, in accordance with the invention, in a presence detection system which comprises at least one presence detecting module, optionally at least one physical-state detection module and at least one central station module, each of said modules housing the electronics required for the specific purposes of the modules and being further provided with a standard power plug for the local power network or mains insertable in a standard mains socket, the power network serving as the transmission network for the carrier-current transmission of information between the modules, the or each central station module being provided, in addition with a wireless link to a manually operated keyboard which can be used to turn on and off the central station, to program it or alter a program, to manually override a program, to cause the central station to survey the remote modules for readiness of state conditions or to otherwise allow an operator to control the system.

Each of the modules can be provided with the usual capacitive coupling network enabling transmission of the carrier current wave to the mains and receipt of the information transmitted along the mains and carried in the form of FSK modulation of the carrier.

The or each presence detector module can, therefore, have a presence sensor of any desired type, a printed circuit or other circuitry for generating a presence signal and transmitting it together with a module-identification signal, if desired, by carrier current transmission along the mains and means responsive to the central module for signalling readiness or a defect in the module, in the transmission net or at the central station or module.

The simple plugging of the modules into standard power outlets along the power mains anywhere in a building, apartment or group of buildings serviced by a common power line readily can set up the entire system for immediate use. All of the modules can have standby (usually battery) power for use in the event of a failure of supply through the mains, but otherwise can be energized by the mains.

Thus the present invention provides presence-detecting system to be used as an anti-intrusion alarm, based on the use of numerous devices (modules) equipped with sensors (for instance infrared or microwave) and which, once connected to the existing electric network by means of the incorporated plug, can communicate among themselves by using the technique of conveyor waves (carrier current technology). One such device, being provided with an actuator for the control of the electric power equipment, actuates an acoustic signal when a presence is detected by any of the detecting devices.

The main advantage of the system consists in the fact that it can use an already existing connection network (the common electric network) without having first to provide complex and costly specific installations, as well as enabling the use of a large number of detectors, which can also be increased subsequently to the first installation.

There are also other objects which can be attained as will be subsequently described in greater detail and which will all be attained by the system of the present invention, characterized by the fact that it comprises a combination of remote presence detectors (such devices can also be equipped with gas or fume detectors, yielding a complete alarm network), one or more devices having the functions of control and actuation, and a radio transmitter provided with a keyboard with a programmable activation/deactivation combination of the same system.

Brief Description of the Drawing

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
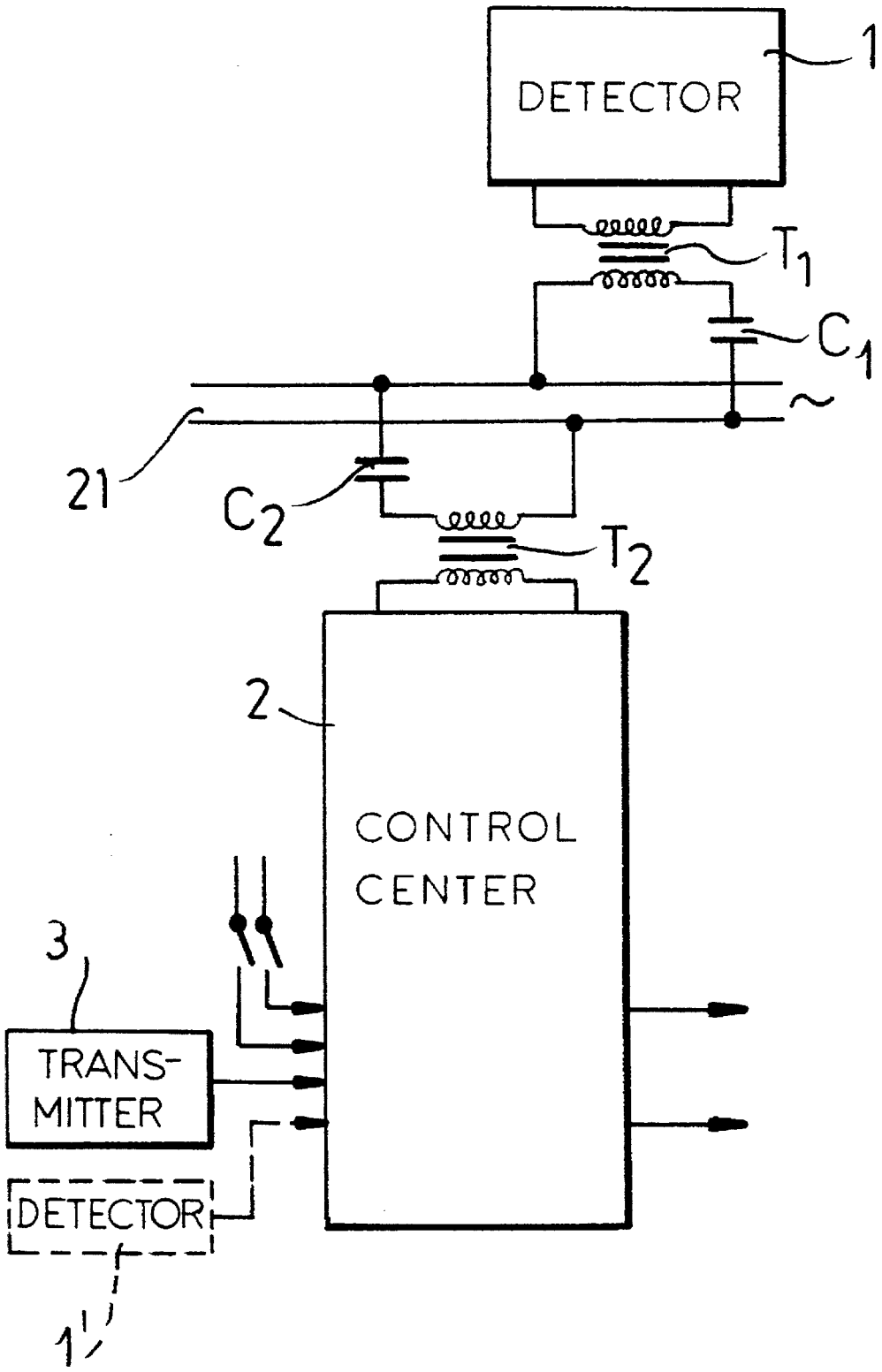
FIG. 1 is a block diagram of the main elements constituting the system.
Figure 4:
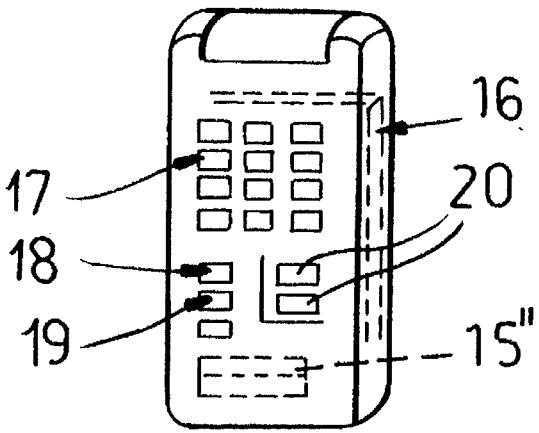
FIG. 4 is a diagrammatic perspective view which shows the transmitter equipped with the keyboard for the programmable combination.
Figure 3:
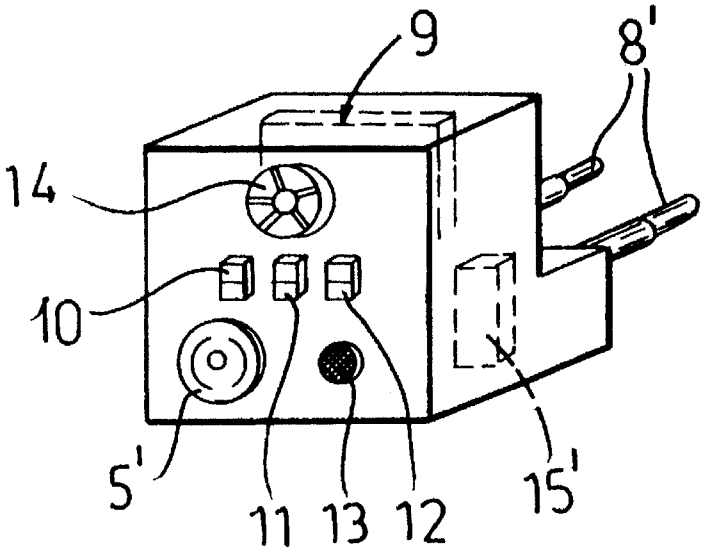
FIG. 3 is a diagrammatic perspective view which shows the control center.
Figure 2:
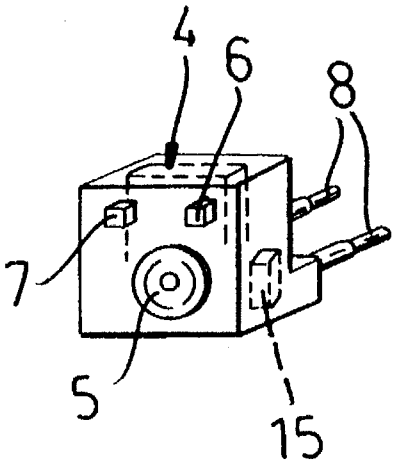
FIG. 2 is a diagrammatic perspective view which illustrates schematically a remote presence detector.

The anti-intrusion network having the purpose to detect and signal a human presence inside a domestic environment, as well as other situations such as gas or fume presence, can be described schematically by its following principal elements:

one or more detectors (detector modules) 1 for sensing remote presences;

a center (control center module) 2 for the control of the entire network, equipped in addition with a presence-detecting sensor therefore behaving also as a remote detector; and a transmitter 3 provided with a keyboard with a programmable combination for the command via radio for the engagement/disengagement of the alarm system and in radio (wireless) communication with the control center module 2. The connection between the remote detectors 1 and the central unit 2 takes place through the electric network (mains) of 220 V, 50 Hz which performs the double function of current supply and transmission support for the information (conveyor waves) by carrier current techniques. In the United States of America, of course, use is made of the standard 110 V, 60 Hz or 220 V, 60 Hz mains.

All elements of the anti-intrusion alarm network are equipped with maintenance-free, rechargeable batteries which continue to insure the operation for short periods of time even when there is an interruption of the 110 or 220 V current.

The activation/deactivation of the anti-intrusion alarm system is controlled by means of the portable transmitter 3 provided with a keyboard with a combination which communicates with the center 2 for the actuation of the network by means of radio waves. The remote presence detector consists essentially of a printed electronic circuit 4 connected with a sensor 5 for detecting the infrared radiation emitted by the human body, or able to sense the presence of gas or fumes. The signal is generated and transmitted to the center 2 via the electric network 21, becoming also visible due to the lighting of a LED 6 with red light, while the impossibility to communicate with the center 2 is made visible by the lighting of a LED 7 with yellow light.

These elements together with the batteries 15 for independent supply, are enclosed in a box provided with plug 8 for the insertion in a standard wall outlet of the electric network of 110 or 220 V. The control center consists essentially of a printed electronic circuit 9 capable to receive signals emitted by the remote sensors (detectors) and to inform the outside world by means depending on the state of said center (alarms for triggering or release). The center 2 is equipped with a sensor 5' for detecting infrared radiation or other types analogous to the remote detectors; a series of pilot lights red 10, yellow 11, green 12, stable or flashing; a acoustic signal 13 (buzzer) to indicate the operations of engaging and disengaging of the alarm system; a siren 14 for signalling an alarm in progress; the supply batteries 15'. All these elements are enclosed in a box provided with a plug 8' for insertion in the electric network of respective standard outlet of the 110 V or 220 V.

The transmitter provided with a keyboard with programmable combination consists essentially of a printed electronic circuit 16 capable to convert to radio impulses the access code to the anti-intrusion system, processed on the keyboard 17 according to a digital code selected by the user.

All signalling related to the programming on keyboard 17 will be made evident by the acoustic signal 13 (buzzer) inserted in center 2. These elements are also enclosed in a box provided with an electric battery 15" for independent supply.

All of the modules 1, 2 of the system which are connected to the power network 21 by the plugs 8, 8' and wall outlets (not shown) of the network, have capacitive couplers compressed of transformers $T_1$, $T_2$ and capacitors $C_1$, $C_2$ (in series with the winding connected across the means) to provide carrier current coupling with the network 21.

The anti-intrusion alarm system consisting of the above-described elements operates in the following manner.

The remote presence detector can be in the following situations:

a/ operating without the alarm: in this situation the detector informs the center 2 periodically (i.e. every 4 minutes) about its own state;

b/ operating with the alarm: the remote detector sends immediately a signal to the center 2 and to the terminal of the transmission, the device sets itself in a blackout, which means that for two minutes it does not send any message;

c/ signalling of communication problems: due to the periodic communications about the state of the remote sensor it is possible to check the validity of the connection between the remote detector and the center 2, and whenever the above-mentioned communication does not elicit a response, the sensor signals this situation by turning on its own LED 7 with the yellow flashing light.

d/ alarm signals: The signalling of alarm conditions on the local visual display device (red LED 6) is related to the state of the center 2 and the presence of the voltage of the 200 V network, while then in the presence of such voltage if the alarm system is disengaged, the detector 1 repeats on its own LED the alarming conditions signalled by its own sensor; in all other situations the LED remains turned off, particularly when the 110 or 200 V network is out, which makes it possible to extend the independent supply afforded by the internal battery 15.

The control center can be in the following situations:

a/ operating in the absence of alarm: in the absence of alarm signals coming from the remote detectors 1 and from the local sensor 5 of the center 2, the LED of an appropriate color of the latter can indicate a disengaged alarm system (continuous red light 10) or an engaged alarm system (continuous green light 12), or an alarm system in the process of being engaged (flashing green light 12); (in the transition from a disengaged system to an engaged system a waiting period (e.g. two minutes) is imposed to the operating regions, in order to allow the user to engage the alarm and exit the house without causing the intervention of the system) or it can indicate a communication error between the center 2 and a remote detector 1 (flashing yellow light 11);

b/ operating in the presence of an alarm with disengaged system: the LED passes from the fixed red light 10 to the flashing red light, in order to signal that the alarm is given by the sensor 5, internal to the center 2, the signal remains for the duration of the alarm condition, while in order to signal that the alarm was given by the remote detector 1, the signal lasts for instance from 4 to 8 minutes;

c/ operating in the presence of alarm and engaged system: the siren 14 of center 2 is activated and the visual LED passes from a green fixed light to a flashing red light, the acoustic activation persists for instance from 4 to 8 minutes, after the alarm conditions have ceased;

d/ acoustic signals of system engagement: the buzzer 13 of the center 2 emits three sound pulses interrupted by a second of silence, at the same time the green LED starts to flash;

e/ acoustic signal of system disengagement: the buzzer 13 of the center 2 emits a continuous sound for the duration of three seconds and the red LED becomes fixed.

On the keyboard with programmable combination of the transmitter 3 the following operations can be set:

a/ in order to engage the alarm system it is necessary to digitize correctly the current activation code and in the end to press the "ON" key 18 of the keyboard;

b/ in order to disengage the alarm system it is necessary to digitize correctly the current activation code and in the end to press the "OFF" key 19 of the keyboard.

c/ in order to program a new code: the center 2 is set in the programming mode, digitizing the old code and pressing at the same time the two opposite keys 20 marked "PROG" on the keyboard; the center 2 in response has to signal that it entered the programming phase by means of five seconds of intermittent acoustic signals of buzzer 13. Subsequently the new code is digitized and the operation is concluded by pressing simultaneously the two opposite keys 20 of the keyboard marked with the inscription "PROG"; if the center 2 produces another five seconds of intermittent acoustic signal, the new code has been accepted, while the center 2 exits the programming phase automatically if it does not receive the new code within 30 seconds.

The operations which can be performed on the remote control are as follows:

a/ engagement and disengagement of the system through command keys which set the alarm system in a state of activation or deactivation;

b/ in order to establish a personalized access code: the old personalized code is digitized on the keyboard and two opposite programming keys on the keyboard marked "PROG" are pressed; the center 2 signals that it is entering the programming phase with an acoustic signal (intermittent sound of the buzzer for five seconds). Subsequently the new program code is digitized on the keyboard and again the operation is concluded by pressing programming keys on the keyboard marked "PROG"; if the center 2 emits another five seconds of intermittent acoustic signal, the new code has been accepted, while the center 2 exits the programming phase automatically if it does not receive the new code within thirty seconds.

In the actuation practice the components of the system, center and remote detectors, can be either elements with the function of detectors and/or actuators, operating at the same rank level, thereby being functionally interchangeable.

The described anti-intrusion system can coexist on the same 110 V or 200 V electric line with other various systems and networks, without creating disturbance or interference; all this is possible because this system is equipped with its own elements for signal filtering, analyzing and decoding.

In fact the microprocessor is capable to manage via software the message collision in the network.

The present invention, illustrated and described schematically by way of example of a possible practical embodiment can be extended to those variants of equivalent accessories, shape, materials which for this reason can encompassed by the scope of the following claims.

I claim:

1. An intrusion alarm system, comprising:

a multiplicity of identical presence-detecting modules each having a housing, a sensor on said housing responsive to the intrusion of a person in a region of said sensor, a plug directly projecting from said housing, configured to be inserted into a standard outlet of an electrical power network having a multiplicity of standard outlets, and mounting the housing on one of said outlets, and a circuitry connected to said sensor and said plug and provided with means for delivering first signals being transmitted by a carrier current of information along said electrical power network to a control center module and means for response to second signals being transmitted by said carrier current from said control center module to one of said presence-detecting modules for informing said control center module of its own state, each of said presence-detecting modules being selectively mountable on said one of the multiplicity of outlets of said network;

wherein said control center module has a housing, a plug on said housing of said control center module configured to be inserted into said one of the standard outlets of said electrical power network, and a control circuitry connected to said plug and provided with means for response to said first signals being transmitted from said presence-detecting module and for transmitting said second signals to each of said presence-detecting modules by said carrier current, of the second signals by said control center module interrogating said presence-detecting modules for monitoring the status of said presence-detecting modules; and a remote control unit for said control center module in wireless radio communication therewith and formed with a keyboard enabling programming and control of said control center module, said control center module and all of said presence-detecting modules being functionally interchangeable and mountable at any of said outlets of said network, each of said presence-detecting modules comprises an infrared radiation detector forming said sensor, a battery serving as an independent power source for emergency operation of the system upon a failure of said network, and at least one pair of differently colored pilot lights, said control center and each of said presence-detecting modules having identical electronic elements enabling said modules to be used functionally interchangeably, said first and second signals between each of said presence-detecting modules and said control center module are transmitted through said network by said carrier current transmission, at least one of said presence-detecting modules is provided with another sensor for gas and fumes.

2. The system defined in claim 1 wherein said remote control unit comprises a plurality of command keys on said keyboard, and a radio transmitter communicating with said control center module.

* * * * *